United States Patent [19]

Allen

[11] Patent Number: 4,800,784

[45] Date of Patent: Jan. 31, 1989

[54] APPARATUS FOR REMOVING CORKS FROM BOTTLES

[75] Inventor: Herbert Allen, Houston, Tex.

[73] Assignee: Hallen Company, Houston, Tex.

[21] Appl. No.: 168,163

[22] Filed: Mar. 15, 1988

[51] Int. Cl.[4] ..... B67B 7/02

[52] U.S. Cl. ..... 81/3.36; 81/3.48

[58] Field of Search ..... 81/3.36, 3.48, 3.07, 81/3.45

[56] References Cited

U.S. PATENT DOCUMENTS

| | | | |
|---|---|---|---|
| 4,276,789 | 7/1981 | Allen | 81/3.36 |
| 4,291,597 | 9/1981 | Allen | 81/3.48 |
| 4,377,096 | 3/1983 | Allen | 81/3.36 |
| 4,429,444 | 2/1984 | Allen | 140/86 |

*Primary Examiner*—Roscoe V. Parker

*Attorney, Agent, or Firm*—Browning, Bushman, Zamecki & Anderson

[57] ABSTRACT

An apparatus for removing corks from bottles is adapted to allow for automatic ejection of the cork from the apparatus, after the cork has been withdrawn from the bottle, by reverse rotation of the corkscrew. The apparatus comprises a corkscrew having a first helical section with a first outer diameter and a second helical section disposed below the first section and with a second outer diameter greater than the first outer diameter so that an upwardly directed screw shoulder is formed between the sections. A handle is fixed to the upper end of the corkscrew. The corkscrew is longitudinally movable with respect to a guide frame therefor. The guideframe includes stops for abutting the top of a bottle and spacers extending upwardly from the stops and defining a cork receiving space for receipt of a cork as it is withdrawn from a bottle by the apparatus. Catches are connected to the spacers, and disposed in the cork receiving space, the catches being engageable with a cork to prevent rotation thereof. Upward movement of the corkscrew shoulder with respect to the spacer means is limited by the screw.

32 Claims, 4 Drawing Sheets

FIG. 3
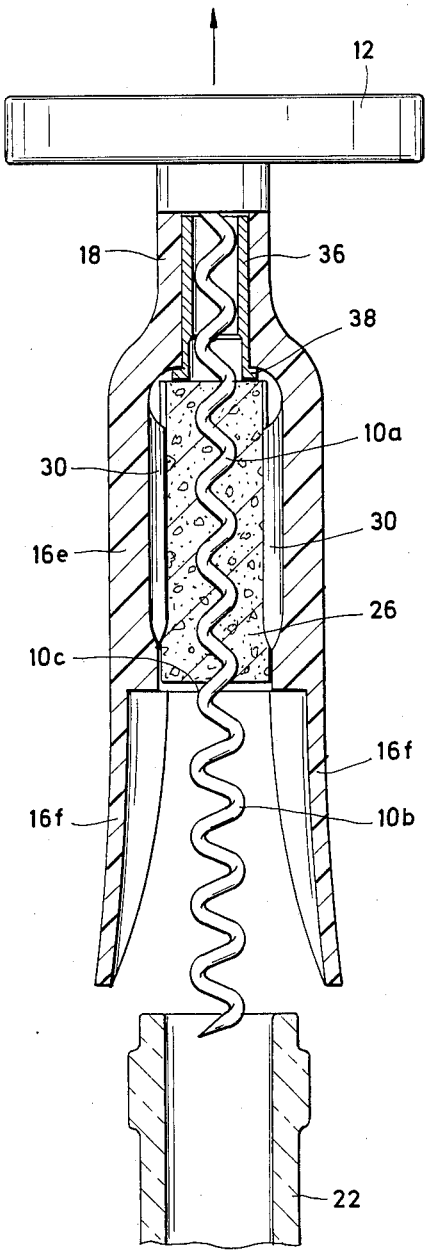
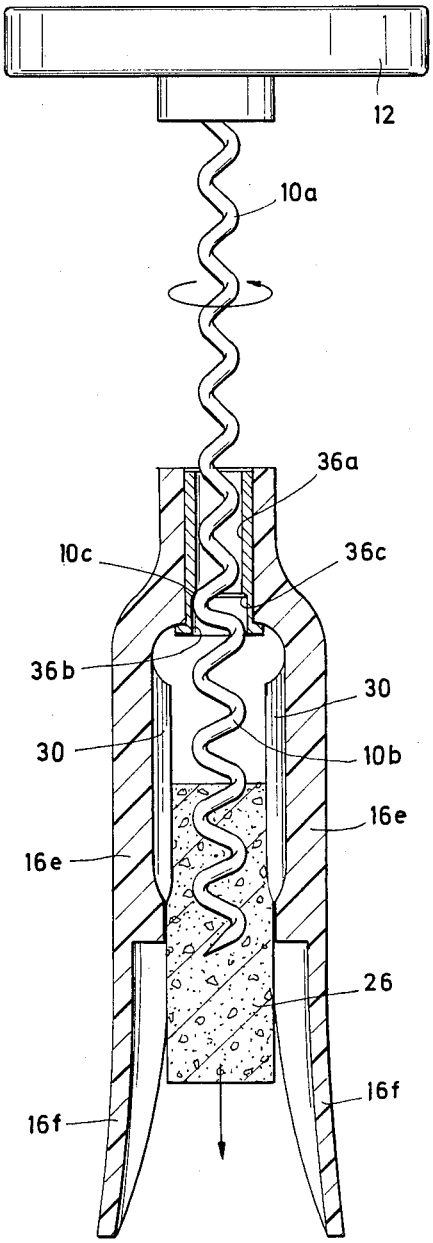
FIG. 4

FIG. 9
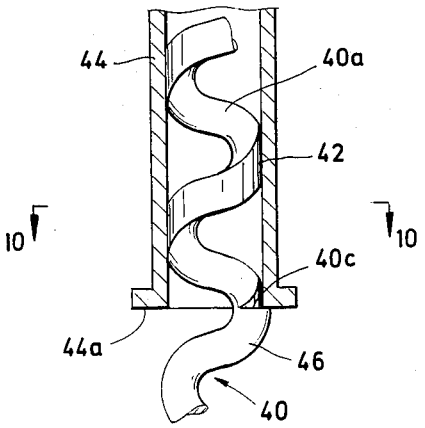
FIG. 10
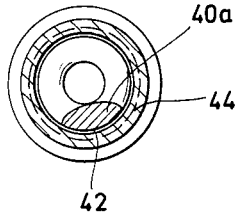
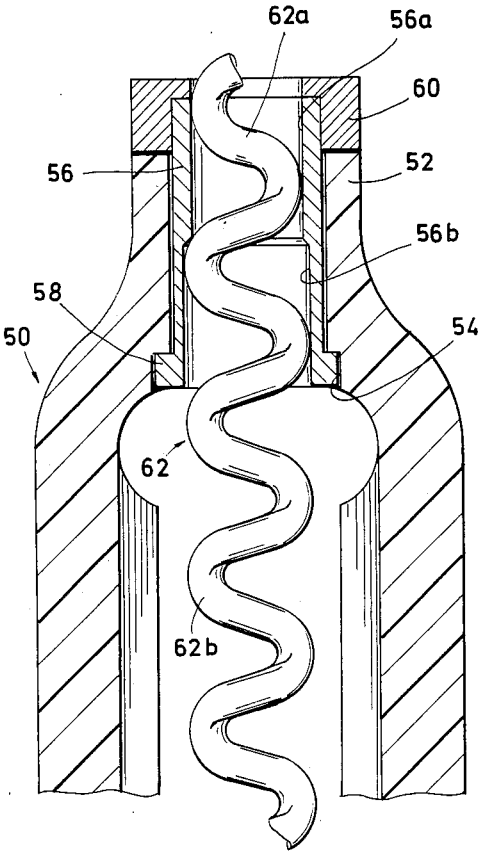
FIG. 11
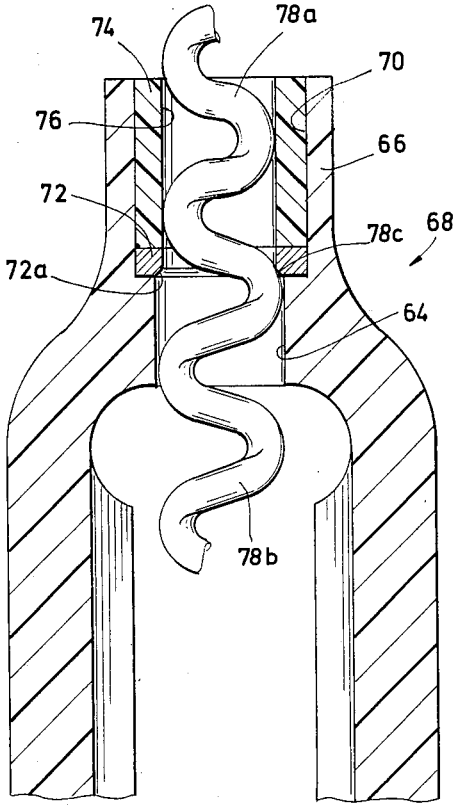
FIG. 12

APPARATUS FOR REMOVING CORKS FROM BOTTLES

BACKGROUND OF THE INVENTION

The present invention pertains to cork extracting apparatus of the types generally disclosed in prior U.S. Pat. Nos. 4,276,789, 4,291,597, 4,377,096, and 4,429,444. My prior U.S. Pat. Nos. 4,276,789 and 4,291,597 disclose cork extracting apparatus of the type for which the term "self-puller" has been coined. A guide frame is provided for guiding a corkscrew into a cork and for limiting downward movement of the corkscrew with respect to the bottle. When the downward movement has been thus limited, the user continues to rotate the handle in the same direction as for driving the screw into the cork. Since the screw can move down no farther, the cork should, in theory, then climb threadedly upwardly on the corkscrew and out of the bottle.

It has been found, in practice, that self pullers prior to the inventions of U.S. Pat. Nos. 4,276,789 and 4,291,597 did not always remove the cork satisfactorily in the intended "self-puller" manner. My prior U.S. Pat. Nos. 4,276,789 and 4,291,597 improved the operation of the self-puller by providing a friction-reducing coating on the corkscrew, which not only lessened the applied force required to drive the screw into the cork, but also helped to ensure that the cork would climb substantially all the way out of the bottle in the self-puller fashion, and again, with a reduction in the necessary applied force. Other improvements were provided, e.g. improvements in the guide frame, including means for gripping the bottleneck so as to better ensure correct alignment of the apparatus with the bottle.

My subsequent U.S. Pat. No. 4,377,096 discloses further improvements in this type of cork extracting apparatus. Specifically, U.S. Pat. No. 4,377,096 discloses a guide frame provided with catch means in the cork receiving space defined by the guide frame above the top of the bottle. The catch means engage the cork as it is climbing out of bottle and prevent it from rotating. Thus, the catch means not only further ensure that the entire cork is removed, by self-puller action, so that not even a little bit of pulling is required, but also prevent breakage of old and fragile corks, which might otherwise crumble into the wine.

FIGS. 13–16 of my prior U.S. Pat. No. 4,377,096 disclose an embodiment in which the corkscrew proper and attached handle are not removable from the guide frame as in the other embodiments, but rather, are interconnected with the guide frame by a set of rails. The edges of the rails also serve as the catch means. With this embodiment, the interconnection between the corkscrew and guide frame limits upward movement of the corkscrew with respect to the guide frame. This, coupled with the fact that the catch means will prevent rotation of a cork which has been removed from a bottle and is disposed in the cork receiving space or "window," allows the cork to be automatically ejected from the apparatus. More specifically, with the corkscrew in its uppermost position with respect to the guide frame, and still engaged with the cork, reverse rotation of the corkscrew (in the opposite direction as that used for removing the cork from the bottle) will cause the cork to climb threadedly downwardly along the screw.

Since the time of my prior inventions, as described just above, other cork extracting devices have appeared on the market utilizing various other means of interconnecting the corkscrew with a guide frame, and also incorporating some type of catch means, so that cork ejection could be accomplished by reverse rotation of the screw. However, a disadvantage of all of these devices, including that shown in FIGS. 13–16 of my own prior patent, is the relative complexity, and more specifically, the fact that substantial extra parts have to be added to the apparatus to interconnect the corkscrew and the guide frame.

British Patent No. 10,176 to Loach discloses a device which is somewhat more simple in that upward movement of the corkscrew with respect to the guide frame is accomplished by means of a shoulder formed on a straight shank integral with and extending upwardly from the corkscrew helix and carrying the handle at its other end. However, even this device involves disadvantages in terms of the unnecessary length and complexity associated with the use of the straight shank and the shoulder thereon.

SUMMARY OF THE INVENTION

In accord with the present invention, a much simpler means of limiting upward movement of the corkscrew subassembly with respect to the guide frame is provided. Specifically, the helical corkscrew itself is provided with first and second sections, with the first or upper section having a smaller outer diameter than the second or lower section. Thus, a shoulder is formed on the helical corkscrew itself, directed generally upwardly, and this shoulder is abuttable with means which limit upward movement of the corkscrew with respect to the guide frame.

In some embodiments, the limit means comprises an annular screw guide which is a part of the guide frame, and may even be at least partially integral with the annulus which joins the upper ends of the guide frame spacers. In other embodiments, there is a floating sleeve or bushing, which can move both longitudinally and rotatably with respect to the guide frame annulus or "guide base", but whose upward movement with respect thereto is limited.

Preferred embodiments of the invention preferably include other features of my other prior patents, including the friction reducing coating on the corkscrew. When the corkscrew includes such a coating, the screw step formed between the first and second sections thereof may have its coating prematurely worn by repeatedly rubbing against the abutting limit means whenever a cork is being ejected from the apparatus.

Thus, at least a part of the limit means is preferable rotatable in the annulus at the top of the guide frame regardless of whether that part is longitudinally fixed in the guide frame or floating. The rotatable part of the limit means defines the abutment for the screw step formed between the first and second sections of the corkscrew. Thus, upward movement of the corkscrew with respect to the guide frame is limited, but when the corkscrew is rotated, it will not rotate against and rub the immediately abutting surface, but rather, the corkscrew and rotatable part of the limit means together will rotate with respect to the guide frame, and this in turn prevents the uneven wear pattern referred to above.

Even if the corkscrew is not so coated, the rotating part of the limit means serves as a bearing which can help stabilize the screw and facilitate rotation thereof.

The aforementioned abutment on the limit means can be formed at its lower end, but more preferably, is formed part way along the length thereof. For example, the screw guide or bushing may have first and second portions, of different inner diameters, sized for sliding fits on the first and second sections, respectively, of the corkscrew. Then, if the screw guide as a whole is long enough to engage the corkscrew over at least one full turn of its helix, and even more specifically, if the second portion of the screw guide engages at least one half turn of the second portion of the corkscrew, the tendency of the corkscrew to twist or deform during the cork ejection process is alleviated. It is even more helpful if the first or upper portion of the screw guide also engages at least one half turn of its resective section of the corkscrew. This is particularly helpful if the corkscrew is of the wire worm or "true helix" type generally preferred by the art.

Preferred embodiments of the invention have other advantageous features, which will be described more fully below.

A principal object of the invention is to provide a helical corkscrew with upper and lower sections of differing outer diameters for limiting upward movement of the corkscrew with respect to a guide frame, the guide frame having catch means for preventing rotation of a cork which has been extracted from a bottle by the apparatus.

Another object of the present invention is to provide such a cork extracting apparatus in which a friction reducing coating can be used on the corkscrew without danger of uneven wearing at the shoulder formed between the first and second sections of the screw.

Another object of the present invention is to provide such an apparatus utilizing a free floating sleeve interengagable between the corkscrew and the upper annular portion of the guide frame.

Still other objects, features, and advantages of the present invention will be made apparant by the following detailed description, the drawings, and the claims.

BRIEF DESCRIPTION OF THE DRAWINGS

FIG. 3 is a view similar to those of FIGS. 1 and 2 showing the apparatus after the cork has been withdrawn from the bottle and the apparatus has been removed from the bottle.

FIG. 4 is a view similar to those of FIGS. 1–3 showing the cork ejection process.

FIG. 9 is a detailed view of a modified form of screw.

FIG. 10 is a transverse cross-sectional view taken on the Line 10—10 of FIG. 9.

FIG. 11 is a longitudinal cross-sectional detailed view of another embodiment of the invention.

FIG. 12 is a view similar to that of FIG. 11 showing still another embodiment of the invention.

DESCRIPTION OF THE PREFERRED EMBODIMENTS

Figure 1:
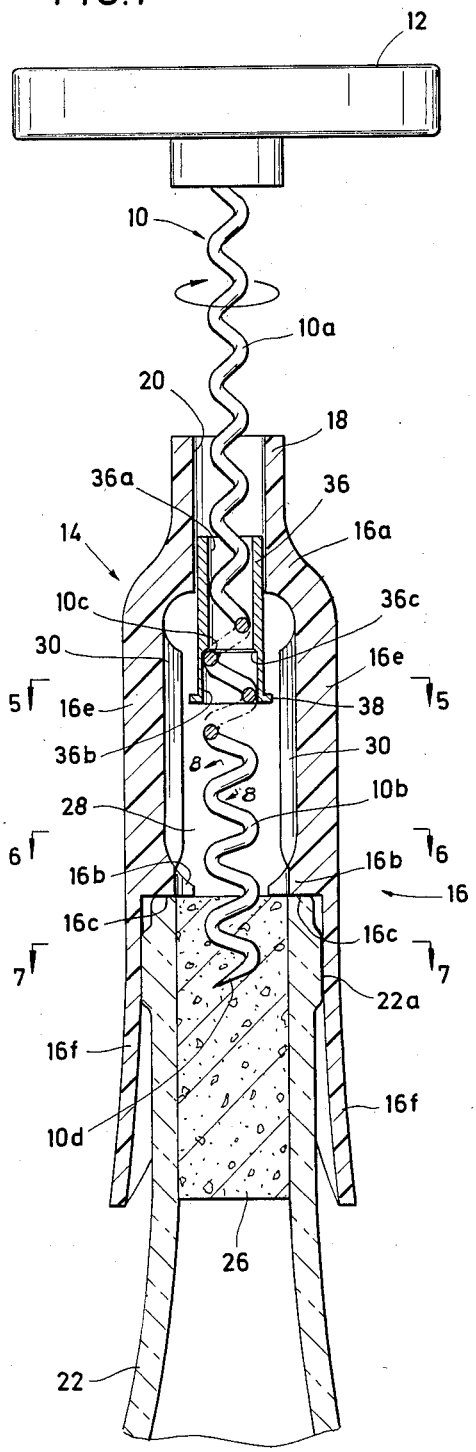
FIG. 1 is a longitudinal cross-sectional view of a first embodiment of the invention showing the parts in their relative positions for first driving the corkscrew into a cork.

FIGS. 1–8 show a first embodiment of cork extractor according to the present invention. The term "cork extractor" has been coined to distinguish the apparatus as a whole from the corkscrew proper which forms a part of that apparatus. However, it will be understood that, in more common terminology, the apparatus as a whole might be referred to as a "corkscrew." In general, the apparatus is of the same type disclosed in my prior U.S. Pat. Nos. 4,276,789, 4,291,597 and 4,377,096. It should be understood that the various features disclosed in these prior patents may be incorporated in various embodiments of the present invention, and said prior patents are therefore expressly incorporated herein by reference.

Referring now to FIGS. 1 and 5–8, the apparatus comprises two main sub-assemblies. One such sub-assembly includes the corkscrew 10 and the handle 12 which is affixed to the upper end of the corkscrew. This sub-assembly 10, 12 will be referred to herein as the "cork engaging member."

The other major sub-assembly is the guide frame or holder 14. Guide frame 14 is of generally bifurcated configuration, including a pair of longitudinally extending, diametrically opposed legs 16. Each of the legs 16 curves inwardly at its upper end to form a shoulder-like area **16*a*, and these shoulder areas of the legs are connected by an uppermost annulus or guide base 18 having a longitudinal cylindrical bore 20. As used herein, and unless otherwise noted, terms such as "longitudinal," "radial," etc. will be used with reference to the axis of the corkscrew 10**. Terms such as "above" and "below" will refer to the apparatus as illustrated, i.e. as positioned for normal use.

Figure 6:
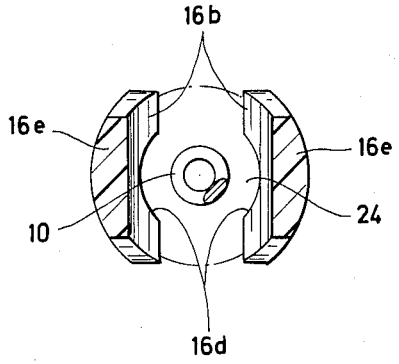
FIG. 6 is a transverse cross-sectional view taken on the Line 6—6 of FIG. 1.

Part way along the length of each leg 16 there is a radially inwardly extending flange **16*b* which forms a downwardly facing stop shoulder 16*c*. Shoulders 16*c* lie generally in a common plane perpendicular to the axis of the apparatus and extend inwardly far enough to rest on the top of a bottle 22 thereby limiting downward movement of the guide frame 14 with respect to the bottle 22. As best seen in FIG. 6, the flanges 16*b* define a gap 24 through which the cork 26 can pass, and the inner surfaces 16*d* of the flanges 16*b*, which define gap 24, are arcuate to facilitate passage of the cork 26**.

With shoulders **16*c* engaged with the top of the bottle 22, the upper parts 16*e* of legs 16 above shoulders 16*c* serve as spacers spacing the guide base 18 above the bottle top by a distance adequate to allow receipt of a cork. Also, the lateral spacing of spacers 16*e* is sufficient to accommodate a cork. Thus, the spacers 16*e* define therebetween a cork receiving space or "window" 28**.

The parts **16*f* of legs 16 extending downwardly below shoulders 16*c* serve as gripping means for gripping or grasping the neck of the bottle 22. Preferably, the entire guide frame is molded of a strong resiliently flexible plastic such as a polycarbonate or an ABS resin, so that legs 16 are flexible both inwardly and outwardly toward and away from each other. This flexibility occurs not only in the lower gripping elements 16*f*, but also in the spacers 16*e*. It is the flexibility in the spacers 16*e* which allows for deflection of the legs 16 in the vicinity near the top of the bottle 22, and this is primarily responsible for allowing the gripping elements 16***f* to grasp the bottle at its drip ring 22*a*. This, coupled with the transverse coplanar shoulders 16*c*, ensures not only centering of the device with respect to the bottleneck, but also good parallel alignment of the guide frame bore 20 with the bottle. The gripping elements 16*f* extending downwardly below the drip ring 22*a* are even further flexible. They not only provide a convenient and stable area for the user to grasp, with an action similar to encircling the bottleneck with the hand, but the additional flexibility in this lower part of the guide frame provides for an even more firm grasp on the bottle, and in at least some instances, may allow the user to grip the bottle at a second point spaced below the drip ring 22*a*.

Figure 5:
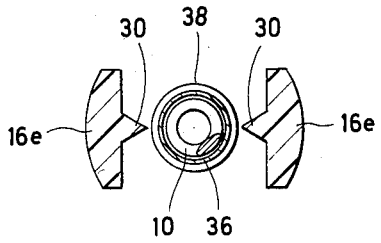
FIG. 5 is a transverse cross-sectional view taken on the Line 5—5 of FIG. 1.
Figure 7:
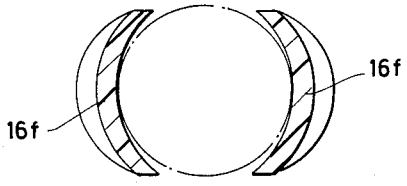
FIG. 7 is a transverse cross-sectional view taken on the Line 7—7 of FIG. 1.

Referring to the cross-sectional views of FIGS. 5–7, it can also be seen that the outer surfaces of the legs 16 are generally arcuate, not only to follow the configuration of the bottle and cork, but also to provide for a more comfortable fit in the user's hand. Gripping elements 16*f* and flanges 16*b* are also arcuate on their inner sides to follow the configuration of the bottle and cork respectively.

Finally, referring again to FIG. 1, the guide frame 14 includes catch means in the form of ridges 30, each extending longitudinally along a respective one of the spacers 16*e* and extending radially inwardly therefrom into the cork receiving space 28. As best seen in FIG. 5, the inner edges of the ridges 30 are thin so that they can better engage the cork as it emerges from the bottle. Ridges 30 are integrally molded as part of the guide frame 14.

The apparatus, as thus far described, is quite similar to that of my prior U.S. Pat. No. 4,377,096 except that the ridges 30 are longer for a purpose to be described more fully hereafter.

Figure 8:
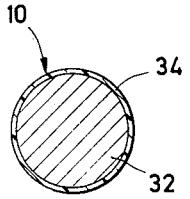
FIG. 8 is a detailed cross-sectional view of the corkscrew taken on the Line 8—8 of FIG. 1.

Like those of my prior patents, corkscrew 10 comprises a central metallic body 32, and an outer layer 34 of friction reducing material, e.g. a coating comprising polytetrafluoroethylene bonded to body 32 (see FIG. 8). However, corkscrew 10 differs from those of my prior patents in that the parameters of its helix are not uniform over its entire length. On the contrary, a first or upper portion 10*a* extends downwardly from the handle 12 and comprises approximately half the length of the corkscrew 10. Continuous with section 10*a* and extending dowardly therefrom is another section 10*b*, whose outer diameter is larger than that of section 10*a*. At the very bottom of section 10*a* is the pointed tip 10*d* of the corkscrew, which is preferably formed in accord with prior U.S. Pat. No. 4,429,444.

The helical corkscrew 10 is of the "true helix" or wire worm type (as opposed to the archimedean or auger type). It is formed from a wire which is wound into a true helix, so that there is a void area along its axis. The corkscrew 10 may be formed by winding a wire around a stepped mandrel, the two steps of which form sections 10*a* and 10*b*, respectively. Accordingly, a transition area or upwardly directed screw shoulder 10*c* is formed at the juncture of sections 10*a* and 10*b*. In this embodiment, the screw shoulder is inclined.

In addition to the two main sub-assemblies, the apparatus comprises a sleeve 36 in the form of a metal sleeve coaxially surrounding corkscrew 10. Sleeve 36 has a cylindrical outer surface sized for a sliding fit in bore 20 so that the sleeve can float longitudinally with respect to the guide frame, and can also rotate within bore 20. The inner diameter of sleeve 36 is stepped. Its upper portion 36*a* has a smaller diameter sized for a sliding fit on section 10*a* of corkscrew 10, while its lower portion 36*b* has a larger diameter sized for a sliding fit on corkscrew section 10*b*. Accordingly, a downwardly facing shoulder 36*c* is formed at the juncture of portions 36*a* and 36*b*, and this shoulder is engageable with screw shoulder 10*c*. Shoulder 36*c* may be bevelled to better fit the screw transition area at screw shoulder 10*c*. At the lower end of sleeve 36 there is a radially outwardly extending flange 38, engageable with the underside of annulus 18 to limit upward movement of sleeve 36 with respect to guide frame 14.

The operation of the device is as follows:

First, the corkscrew 10 is raised up by means of the handle 12. Interengaged shoulders 10*c* and 36*c* will carry the sleeve 36 upwardly along with the corkscrew until flange 38 engages the underside of annulus 18. The interengagement of corkscrew 10 with annulus 18 via sleeve 36 will thereby limit upward movement of corkscrew 10. Since sleeve 36 has a sliding fit in bore 20 and its portions 36*a* and 36*b* have sliding fits on screw sections 10*a* and 10*b*, respectively, screw 10 will be centered and coaxially aligned with bore 20.

The apparatus is placed on a bottle 22 as shown, then the user encircles gripping elements 16*f* with one hand and uses them to grasp the bottle. This centers the guide frame 14, and with it screw 10, on the bottle, while shoulders 16*c* ensure parallel alignment of the axes of the device and the bottle.

With the other hand, the user begins to rotate handle 12, initially exerting a slight downward pressure, to begin driving the corkscrew 10 into the cork 26 as shown in FIG. 1. Once the screw 10 is started into the cork 26 it is no longer necessary to push down on handle 12, but only to rotate the handle. Driving in of the screw 10 is greatly facilitated by coating 34. As the corkscrew 10 moves downwardly, sleeve 36 may be suspended on corkscrew 10 by means of inter-engageable shoulders 10*c* and 36*c*, and thus move down as well. By the time sleeve 36 moves completely out of annulus 18, so that it can no longer co-act between corkscrew 10 and annulus 18 to guide corkscrew 10, corkscrew 10 will have been driven far enough into the cork, on a path generally coaxially aligned therewith, that it will thereafter be self-guiding, and no further guidance in the area of annulus 18 will be required.

Figure 2:
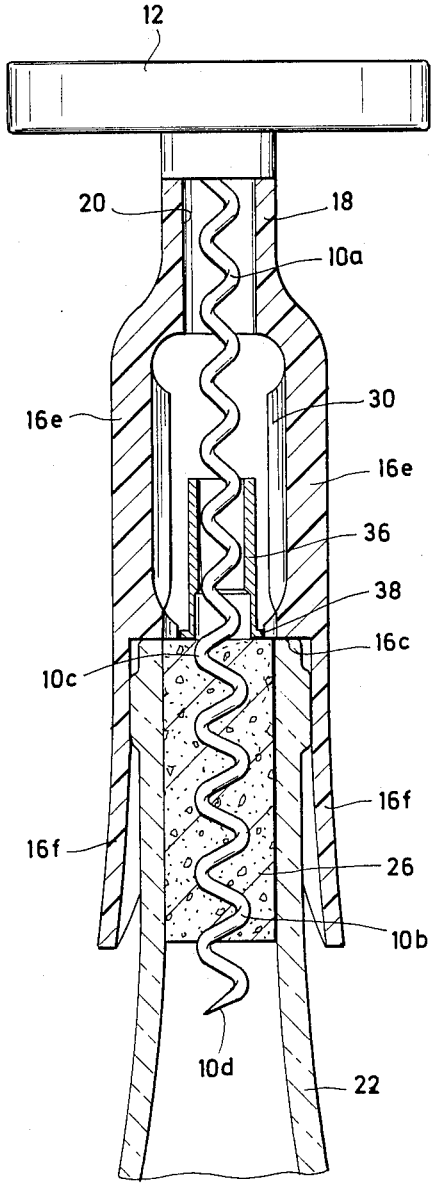
FIG. 2 is a view similar to that of FIG. 1 showing the apparatus after the screw has reached its lowermost position.

Eventually, the bottom of sleeve 36 will abut the top of cork 26, whereupon its further downward movement will be arrested, and the corkscrew 10 can continue moving dowardly through sleeve 36. Then, downward movement of corkscrew 10 is arrested by abutment of handle 12 with the top of annulus 18 as shown in FIG. 2. The length of corkscrew 10 is such that, when in its lowermost position as shown in FIG. 2, its lower portion 10*b* extends dowardly all the way through cork 26, while its upper portion 10*a* extends through the cork receiving space 28.

At this point, the user simply continues to rotate handle 12 in the same direction (clockwise as viewed from above) which was used for driving the screw into the cork. Since the screw can no longer move downwardly, the cork will begin to move threadedly upwardly along the screw and into the cork receiving space 28, pushing sleeve 36 upwardly ahead of it. It is noted that this climbing action of the cork is greatly facilitated by the friction reducing coating 34, which ensures a large differential between the friction between the cork and the corkscrew, on the one hand, and the friction between the cork and the bottleneck, on the other hand.

In some instances, after a major portion of the length of a cork has moved up and out of the bottle, the cork could begin to rotate in the bottleneck, inhibiting further threaded climbing of the cork on the corkscrew. However, the friction reducing coating 34 ensures that the cork will climb threadedly up to a point where it will be engaged by the ridges 30, which can slightly embed into the sides of the cork, and thereby prevent the cork from rotating. Accordingly, the cork can be moved completely out of the bottle and into the cork receiving space 28 by a threaded climbing or "self-puller" action, without the need for any axial pulling by the user. Indeed, if the cork is longer than the cork receiving space, it can even compress longitudinally in order to move completely out of the bottle.

FIG. 3 shows the apparatus after the cork has been completely removed from the bottle. It should be noted that sleeve 36 has been pushed up into bore 20 as far as possible, i.e. with its flange 38 engaging the underside of annulus 18.

In order to eject the cork from the apparatus, the user begins to rotate handle 12 in a reverse direction to that which was used to drive the screw into the cork, in this case, counterclockwise. The cork will be held against rotation by the ridges 30, so that the corkscrew 10 is unthreaded from the cork and moves upwardly therein until its upward movement is arrested by engagement of shoulder 10c with shoulder 36c.

Then, as shown in FIG. 4, by continuing to rotate the handle in the counterclockwise direction, but with the corkscrew restrained against further upward movement, and the cork restrained from rotation by ridges 30, the cork will be caused to move threadedly downwardly along the corkscrew 10 with a reverse self puller type action. Ridges 30 extend far enough down in the cork receiving space 28, to allow such action to move the cork well down along the corkscrew 10. If, toward the end of this operation, the cork moves completely down and off of the ridges 30, it will then be located at a lower point in the guide frame, where there is even more flexibility of the legs 16, and by squeezing the legs 16 inwardly toward each other, the user can continue to prevent cork rotation and thus continue the automatic ejection process until the cork has moved virtually completely off the corkscrew 10. Alternatively, the unwinding can be easily completed by grasping the cork by hand.

It should be noted that, both in removing the cork from the bottle, and in ejecting the cork from the apparatus, the corkscrew rotates in a fixed longitudinal position. When removing the cork from the bottle, as shown in FIG. 2, the corkscrew 10 does not bear forceably against any other part of the apparatus, since downward movement of the corkscrew is arrested by the attached handle 12, bearing against the upper end of the guide base or annulus 18. However, in the cork ejection phase, as depicted in FIG. 4, upward movement is arrested by a part of the corkscrew itself, i.e. shoulder 10c. However, since shoulder 10c bears against sleeve 36, and sleeve 36 is rotatable within annulus 18, the screw 10 and sleeve 36 will rotate jointly, so that the rubbing is between the sleeve 36 and the guide frame 14, rather than between the coated screw 10 and some other part of the apparatus. This prevents premature and/or uneven wear of the coating.

Still referring to FIG. 4, it can be seen that sleeve 36 encloses corkscrew 10 over more than one full turn of its helix. Due to the stepped inner diameter, with each portion 36a and 36b, respectively, being sized for a sliding fit on a respective section 10a or 10b of the corkscrew, sleeve 36 radially supports the corkscrew over this full extent and most importantly, in the area near shoulder 10c. Even more specifically, the length of portion 36b is sufficient to radially abut or support screw section 10b over at least one-half turn of its helix. This counters any tendency of the corkscrew to distort and, for example, for the upper portion of screw section 10b to pull up too far and cant in the sleeve. Likewise sleeve portion 36a abuts and supports screw section 10a over at least one half turn.

Nevertheless, after the apparatus has been used to eject a cork, sleeve 36 can become slightly jammed on the corkscrew 10. It is one of the salient features of this embodiment of the invention that such jamming is self-correcting. The next time the screw is driven into another cork, sleeve 36 will eventually abut that cork, and as the screw continues to move downwardly, and/or as the cork moves upwardly by self puller action, the relative movement of the corkscrew and cork will release the jam and move the sleeve up along the corkscrew.

As previously mentioned, the corkscrew 10 of the embodiment of FIGS. 1–8 is formed by winding a wire on a stepped mandrel. Thus, sections 10a and 10b differ not only in outer diameter, as required for purposes of the invention, but also in inner diameter. It has been found, somewhat surprisingly, that this is not a significant problem, and specifically, that it does not noticeably impede the upward movement of the cork, even though the helical hole formed in the cork by section 10b must pass over section 10a. This lack of significant problem is partially due to the fact that the screw sections are sized and positioned so that section 10a will be located above shoulder 16c when the screw 10 is in its lowermost position. Thus, the cork only begins to move up over section 10a as it is moving up and out of the bottle. When the cork is out of the bottle, it is no longer compressed, and its flexibility and resilience, coupled with the friction reducing coating, allows it to very easily accommodate the slight difference in diameter of section 10a.

Nevertheless, there is a second embodiment of corkscrew, shown in FIGS. 9 and 10, which allows the pitch and inner diameters of the two sections to remain constant, so that the cork may move even more easily from one screw section to the next. This method of screw formation may be advantageous, for example, where a corkscrew is to be used with extremely old and valuable wines, in which the corks are particularly fragile.

Referring specifically to FIGS. 9 and 10, the screw 40 is first coiled to form a helix of constant diameters, pitch, etc. Then, the upper potion of the helix is machined along its outer diameter as shown at 42 to form the upper screw section 48 of smaller outer diameter, while the lower section 40b remains at the original, larger, outer diameter. The inner diameter, pitch, etc., remain constant, with the aforementioned advantages.

FIGS. 9 and 10 also show another form of bushing 44 in which the inner diameter is constant, so that the shoulder on the sleeve which abuts the screw shoulder 40c formed between sections 40a and 40b is simply the lower end 44a of the sleeve 44.

Another advantage of the screw embodiment of FIGS. 9 and 10 is that screw shoulder 40c can be machined as a "square shoulder", i.e. a flat perpendicular to the axis. Together with a similarly square shoulder on the bushing, such as at the underside 44*a* of sleeve 44, this prevents jamming of the sleeve or bushing on the screw, as described above. Thus, this embodiment of screw may be especially useful in connection with embodiments such as those of FIGS. 11 et. seq., in which there is no longitudinally movable or "floating" bushing.

However, a disadvantage of this form of screw is that its cross section is diminished, and it is accordingly weakened. Thus, for ordinary use on relatively young and healthy corks, the screw of FIGS. 1–8 may be preferable.

Turning next to FIG. 11, there is shown another embodiment of the invention in which the screw guide or bushing, while similar in form to that of FIGS. 1–8, is not free floating, but rather, is fixed against substantial longitudinal movement with respect to the guide base, so that it is connected to the guide base, spacers, etc., and actually becomes part of the guide frame.

More specifically, the guide frame includes a main body 50 integrally molded of plastic and generally of the same form as frame 14 of the preceding embodiment except that the guide base or annulus 52 is shorter and has, at its lower end, a counter-bore 54. The screw guide is a bushing in the form of sleeve 56 which has a flange 58 which fits into counter-bore 54 to limit upward movement of sleeve 56 with respect to annulus 52, and sleeve 56 extends through and upwardly beyond annulus 52 where its upper end is press-fitted into a metal ring 60, which abuts the upper end of annulus 52, thus restraining sleeve 56 against downward movement. However, sleeve 56 and ring 60 can rotate with respect to annulus 52, and more particularly, can rotate jointly with corkscrew 62 to prevent rubbing of the latter against the guide frame.

As in the preceding embodiment, sleeve 56 has first and second inner diameters 56*a* and 56*b* sized for sliding fits on corkscrew sections 62*a* and 62*b*, respectively. The length of portion 56*a* is sufficient to engage at least one-half turn of the smaller screw section 62*a*, while portion 56*b* is long enough to engage at least one-half turn of larger screw section 62*b*, for the purpose mentioned hereinabove.

While the embodiment of FIG. 11 lacks the automatic jam clearing function of the floating sleeve embodiment of FIGS. 1–8, it may be desirable for other reasons, such as aesthetic appeal. As mentioned, jamming could be prevented by the use of square shoulders for abutment between the screw and sleeve.

FIG. 12 shows another embodiment in which the larger diameter lower portion 64 of the screw guide is integrally formed on the annulus 66 of the main body 68 of the guide frame. Above portion 64, annulus 66 is counter-bored to receive a short rotatable metal ring 72 which rests on the shoulder formed between bore 64 and counter-bore 70, and a plastic retainer sleeve 74 which is pressed into counter-bore 70 above ring 72 to retain ring 72 longitudinally in place and complete the screw guide, specifically forming the smaller diameter upper portion 76 thereof. Thus, ring 72 defines the shoulder 72*a* between the large and small diameter portions of the screw guide for abutment with the screw shoulder 78*c* formed at the juncture of small and large diameter screw sections 78*a* and 78*b*, respectively. Since it is mainly shoulder 78*c* which would tend to become prematurely worn in the absence of a rotatable portion of the screw guide, ring 72 can effectively prevent wear in that area. Meanwhile, it can be seen that, once again, each portion of the screw guide engages at least one-half turn of the respective mating section of the corkscrew.

Figure 13:
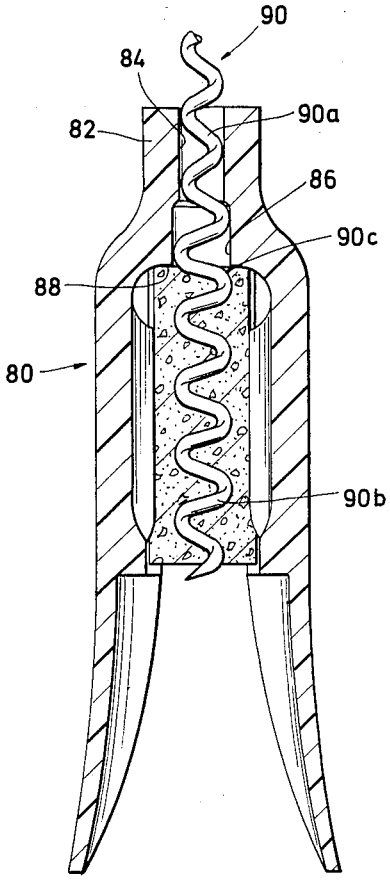
FIG. 13 is a partial longitudinal cross-sectional view of yet another embodiment of the invention, showing the parts in position for beginning the cork ejection process.

Finally, referring to FIG. 13, there is shown an embodiment in which the entire screw guide is not only connected to, but completely integrated with, the annulus of the guide frame as a single integrally molded plastic part. The guide frame 80 has the uppermost annulus 82 whose bore includes a small diameter upper portion 84 sized for a sliding fit on the small diameter section 90*a* of the corkscrew, while the lower portion 86 of the bore is of a larger diameter sized for a sliding fit on large diameter screw section 90*b*. A step or shoulder 88 is formed between portions 84 and 86 for engagement with screw shoulder 90*c*. FIG. 13 shows the apparatus just as the cork ejection process is about to begin, and it can be seen that each section 84 and 86 of the bore in the screw guide 82, engages at least one-half turn of its respective screw section 90*a* or 90*b*.

While this embodiment could entail some premature wear of the friction reducing coating at the screw shoulder 90*c*, it is the simplest embodiment of all, and to that extent, the most aesthetically pleasing and easiest to manufacture. It is only necessary that the corkscrew 90 be inserted into the annulus 82 from the underside thereof before the handle 92 is fixed to the upper end of the corkscrew 90. Any premature wear of the friction reducing coating which might occur at the screw shoulder 90*c* will be located on only a small portion of the total corkscrew surface area, and for most purposes, should not unduly interfere with the effectiveness of the device either in removing the cork from the bottle or ejecting the cork from the apparatus.

Numerous other modifications are possible within the spirit of the invention. By way of example only, the ridge-like catch means of the preferred embodiments illustrated herein are directly connected to the spacers of the guide frame. Other embodiments might include, for example, catch means in the form of prongs extending downwardly from the underside of the annulus, thus only indirectly connected to the spacers. Other modifications will suggest themselves to those of skill in the art. Accordingly, it is intended that the scope of the invention be limited only by the claims which follow.

What is claimed is:

1. Apparatus for removing corks from bottles comprising:

a handle fixed to a corkscrew;

bottle engaging means, including stop means for abutting the top of a bottle and defining a central gap for passage of a cork;

spacer means extending upwardly from said stop means and defining a cork receiving space aligned with said gap for receipt of a cork as it emerges from a bottle;

catch means connected to said spacer means and disposed generally in said cork receiving space, said catch means being engagable with a cork in said cork receiving space to prevent rotation thereof;

said corkscrew being helical and longitudinally movable with respect to said spacer means, said corkscrew having a first section fixed to said handle, said first section having a first outer diameter and a second section disposed below said first section and with a second outer diameter greater than said first outer diameter to form an upwardly directed screw step between said sections;

and limit means abuttable with said screw shoulder and cooperative between said corkscrew and said spacer means to limit upward movement of said corkscrew with respect to said spacer means.

2. The apparatus of claim 1 wherein:

said limit means comprises an annular screw guide connected to said spacer means and disposed above said cork receiving space to form, with said spacer means and said bottle engaging means, a guide frame, said screw guide having at least a first portion with a first inner diameter greater than said first outer diameter of said corkscrew and less than said second outer diameter of said corkscrew.

3. The apparatus of claim 2 wherein at least a part of said screw guide is rotatable with respect to the remainder of said guide frame but restrained against relative longitudinal movement.

4. The apparatus of claim 3 wherein said rotatable part of said screw guide defines the lower extremity of said first portion of said screw guide.

5. The apparatus of claim 4 wherein said corkscrew comprises a central body and an outer layer of friction reducing material.

6. The apparatus of claim 3 wherein said guide frame comprises an annular guide base integrally connected to the upper end of said spacer means, the entire screw guide is a bushing rotatably mounted in said guide base.

7. The apparatus of claim 2 wherein said screw guide is integral with said spacer means.

8. The apparatus of claim 1 wherein said limit means comprises:

an annular guide base integrally connected to the upper end of said spacer means to form, with said spacer means and said bottle engaging means, a guide frame;

and an annular bushing generally coaxially surrounding said corkscrew, said bushing having at least a first portion with a first inner diameter greater than said first outer diameter of said corkscrew and less than said second outer diameter of said corkscrew, said guide base being configured to receive said bushing for longitudinal and rotative movement, said bushing and said guide base having opposed surfaces for limiting upward movement of said bushing with respect to said guide base.

9. The apparatus of claim 8 wherein said corkscrew comprises a central body and an outer layer of friction reducing material.

10. The apparatus of claim 8 wherein said bushing has a sliding fit in said guide base.

11. The apparatus of claim 10 wherein said first portion of said bushing is sized for a sliding fit with respect to said first section of said corkscrew, and said bushing further having a second portion disposed below said first portion with a second inner diameter sized for a sliding fit on said second portion of said corkscrew.

12. The apparatus of claim 11 wherein the combined length of said first and second portions of said bushing is at least as long as the longitudinal extent of one full turn of said corkscrew.

13. The apparatus of claim 11 wherein the length of said second portion of said bushing is at least as long as the longitudinal extent of one half turn of said second section of said corkscrew.

14. The apparatus of claim 13 wherein the length of said first portion of said bushing is at least as long as the longitudinal extent of one half turn of said first section of said corkscrew.

15. The apparatus of claim 14 wherein said corkscrew is of the true helix type.

16. The apparatus of claim 2 wherein said first portion of said screw guide is sized for a sliding fit on said first section of said corkscrew, and said screw guide further having a second portion disposed below said first portion with a second inner diameter sized for a sliding fit on said second portion of said corkscrew.

17. The apparatus of claim 16 wherein the combined length of said first and second portions of said screw guide is at least as long as one full turn of said corkscrew.

18. The apparatus of claim 16 wherein the length of said second portion of said screw guide is at least as long as the longitudinal extent of one half turn of said second section of said corkscrew.

19. The apparatus of claim 18 wherein the length of said first portion of said screw guide is at least as long as the longitudinal extent of one half turn of said first section of said corkscrew.

20. The apparatus of claim 18 wherein said corkscrew is of the true helix type.

21. The apparatus of claim 1 wherein said corkscrew is of the true helix type.

22. The apparatus of claim 21 wherein said corkscrew is formed from a continuous piece of wire wound into continuous end-to-end helicies, having different inner and outer diameters, to form said first and second sections, respectively.

23. The apparatus of claim 21 wherein said first and second sections of said corkscrew have a continuous identical pitch and a continuous identical inner diameter, the transverse cross-section of said first section being reduced at its outer diameter.

24. The apparatus of claim 23 wherein said screw shoulder is generally normal to the axis of said corkscrew.

25. The apparatus of claim 1 further comprising an annulus connected to the upper end of said spacer means to form, with said spacer means and with said bottle engaging means, a guide frame, said annulus receiving said corkscrew for longitudinal and rotative movement;

and wherein said handle is engagable with said guide frame to limit downward movement of said corkscrew relative to said guide frame to a lowermost position of said corkscrew wherein said corkscrew extends below said stop means as well as above said stop means into said cork receiving space.

26. The apparatus of claim 25 wherein, when said corkscrew is in its lowermost position, the first section thereof is disposed above said stop means.

27. The apparatus of claim 26 wherein said corkscrew is formed from a continuous piece of wire wound into continuous end-to-end helices, having different inner and outer diameters, to form said first and second sections, respectively.

28. The apparatus of claim 25 wherein said catch means comprises a plurality of circumferentially spaced ridges extending lengthwise along said spacer means, projecting radially inwardly into said cork receiving space, and having relatively thin inner edges.

29. The apparatus of claim 25 wherein said bottle engaging means further comprises gripping means extending downwardly below said stop means and radially inwardly and outwardly deflectable for gripping bottle necks.

30. The apparatus of claim 29 wherein said gripping means is so deflectable from a point above said stop means.

31. The apparatus of claim 30 wherein said guide frame comprises a pair of diametrically opposed legs joined at their upper ends by said annulus, upper portions of said legs forming said spacer means, lower portions of said legs forming said gripping means, both said upper and lower portions of said legs being radially deflectable, and wherein said stop means comprise shoulders formed on the inner sides of said legs.

32. The apparatus of claim 31 wherein said shoulders lie generally in a common plane perpendicular to the axis of said apparatus.

* * * * *